US010634393B2

(12) United States Patent
Longsworth

(10) Patent No.: US 10,634,393 B2
(45) Date of Patent: Apr. 28, 2020

(54) CRYOGENIC EXPANDER WITH COLLAR BUMPER FOR REDUCED NOISE AND VIBRATION CHARACTERISTICS

(71) Applicant: Sumitomo (SHI) Cryogenics of America, Inc., Allentown, PA (US)

(72) Inventor: Ralph C. Longsworth, Allentown, PA (US)

(73) Assignee: SUMITOMO (SHI) CRYOGENIC OF AMERICA, INC., Allentown, PA (US)

( * ) Notice: Subject to any disclaimer, the term of this patent is extended or adjusted under 35 U.S.C. 154(b) by 2 days.

(21) Appl. No.: 15/654,150

(22) Filed: Jul. 19, 2017

(65) Prior Publication Data

US 2018/0023849 A1 Jan. 25, 2018

Related U.S. Application Data

(60) Provisional application No. 62/366,205, filed on Jul. 25, 2016.

(51) Int. Cl.

| | |
|---|---|
| ***F25B 9/00*** | (2006.01) |
| ***F25B 9/14*** | (2006.01) |
| ***F02G 1/04*** | (2006.01) |

(52) U.S. Cl.

CPC ..... *F25B 9/14* (2013.01); *F25B 2500/12* (2013.01); *F25B 2500/13* (2013.01)

(58) Field of Classification Search

CPC .... F25B 9/00; F25B 9/14; F25B 9/145; F02G 1/043

See application file for complete search history.

(56) References Cited

U.S. PATENT DOCUMENTS 3,045,436 A 7/1962 Gifford et al.
3,119,237 A 1/1964 Gifford et al.
(Continued)

FOREIGN PATENT DOCUMENTS

CN 101063450 A 10/2007
CN 103249914 A 8/2013
(Continued)

OTHER PUBLICATIONS

British Search Report dated Dec. 20, 2017 for the Corresponding British Patent Application No. GB1711688.0.
(Continued)

*Primary Examiner* — Frantz F Jules
*Assistant Examiner* — Erik Mendoza-Wilkenfel
(74) *Attorney, Agent, or Firm* — Katten Muchin Rosenman LLP

(57) ABSTRACT

A cryogenic expander maximizes the energy absorbing capacity of bumpers that prevent the displacer or piston in a pneumatically driven expander from hitting the cold or warm end of a cylinder. A collar at the warm end of the piston which has the same outside diameter as the piston and a lip at the warm end that engages an "O" ring before the piston hits the cold end or bottom of the cylinder. The warm end of the collar also engages an "O" ring before the pistons hits the warm end or top of the cylinder. Having "O" rings that are near the maximum diameter of the cylinder maximizes the amount of energy they can absorb, and thus permits quiet operation of larger size expanders than prior designs.

14 Claims, 3 Drawing Sheets

(56) References Cited

U.S. PATENT DOCUMENTS

| | | | | | |
|---|---|---|---|---|---|
| 4,294,600 | A * | 10/1981 | Sarcia | F25B 9/14 | 137/625.37 |
| 4,310,337 | A * | 1/1982 | Sarcia | F25B 9/14 | 137/625.37 |
| 5,596,875 | A | 1/1997 | Berry et al. | | |
| 6,256,997 | B1 * | 7/2001 | Longsworth | F25B 9/14 | 62/6 |
| 7,674,099 | B2 | 3/2010 | Dunn | | |
| 9,080,794 | B2 | 7/2015 | Longsworth | | |

FOREIGN PATENT DOCUMENTS

| | | | |
|---|---|---|---|
| DE | 101 90 484 | T1 | 6/2002 |
| EP | 0343774 | A2 | 11/1989 |
| JP | 2000-055493 | A | 2/2000 |
| WO | 01/61256 | A1 | 8/2001 |

OTHER PUBLICATIONS

German Search Report dated Feb. 2, 2018 for the Corresponding German Patent Application No. 10 2017 116 805.2.
Chinese Office Action dated Nov. 12, 2019, for the Corresponding Chinese Patent Application No. 201710612029.9.

* cited by examiner

100

200

CRYOGENIC EXPANDER WITH COLLAR BUMPER FOR REDUCED NOISE AND VIBRATION CHARACTERISTICS

BACKGROUND OF THE INVENTION

1. Field of the Invention

This invention relates to a cryogenic expander having reduced noise and vibration characteristics. More specifically, the invention relates to a high capacity expander having a pneumatically driven reciprocating piston producing refrigeration at cryogenic temperatures and which includes a collar bumper with reduced noise and vibration characteristics.

2. Background Information

Most cryogenic refrigerators that are used to cool cryopumps, superconducting MRI magnets, and laboratory research instruments use GM type refrigerators. These typically use air conditioning compressors that have been modified to compress helium and draw less than 12 kW of input power. The expanders have reciprocating pistons that are either mechanically or pneumatically driven. The mechanical drive is relatively quiet because it provides a nearly sinusoidal motion that does not cause the piston to hit the top or bottom at the end of the stroke. The pneumatic drives are simpler but can produce significant noise if the piston hits the top or bottom of the cylinder at the end of the stroke. The same is true for expanders that operate on the Brayton cycle.

U.S. Pat. No. 3,045,436, by W. E. Gifford and H. O. McMahon describes the basic GM cycle. This refrigerator system consists of a compressor that supplies gas at a high pressure to an expander which admits the gas through a warm inlet valve to the warm end of a regenerator heat exchanger, through the regenerator, and then into an expansion space at the cold end of a piston from whence it returns back through the regenerator and a warm outlet valve to the compressor at a low pressure. The '436 patent shows the regenerator external to the cylinder with the piston, and a second pair of valves that cycles gas to the warm end of the piston out of phase with the gas flow to the regenerator. U.S. Pat. No. 3,119,237, by W. E. Gifford shows an improvement of the concept in the '436 patent in the form of a drive stem at the warm end of the piston which reduces the amount of gas used to drive the piston up and down The expander configuration and valve cycling are shown in FIGS. 2-9 in the '237 patent.

The typical GM type expander being built today has the regenerator located inside the piston. The piston/regenerator becomes a displacer that moves from the cold end to the warm end with the gas at high pressure, then from the warm end to the cold end with the gas at low pressure. Since the pressure above and below the displacer is nearly the same, the force required to cause the displacer to reciprocate is small, and can be provided by either a mechanical or pneumatic mechanism. In the descriptions that follow the term piston is used when it may also refer to a displacer.

A pneumatically driven expander operating on the Brayton cycle is described in U.S. Pat. No. 9,080,794 by Longsworth. The Brayton cycle differs from the GM cycle in using a counterflow heat exchanger instead of a regenerator heat exchange to precool the high pressure gas before it is expanded. This requires an additional pair of valves at the cold end of the expander that have to be synchronized with the valves at the warm end. The counterflow heat exchanger has to be external to the piston/cylinder and is substantially larger than an equivalent regenerator. An important advantage that a Brayton cycle refrigerator has relative to a GM cycle expander is its ability to distribute cold gas to a remote load, while the cold expanded gas in a GM expander is contained within the expansion space.

A compressor system that can be used to supply gas to either a GM cycle expander or a Brayton cycle engine is described in U.S. Pat. No. 7,674,099 titled "Compressor With Oil Bypass" by S. Dunn. High and low pressures are typically 2.2 and 0.8 MPa U.S. Pat. No. 6,256,997 to Longsworth describes the use of elastomer "O" rings at the warm end of a GM type displacer as "impact absorbers" to absorb the impact energy of the displacer when it is at the ends of the stroke to avoid the noise and vibration associated with having the displacer hit the warm and cold ends of the cylinder. It accomplishes this by locating "O" rings around the central drive mechanism. While the '997 patent describes the general principal and its application to relatively small and light displacers, the present invention describes a means of applying the principal to larger displacers and pistons in expanders that are producing more refrigeration and have larger and heavier pistons. This is accomplished by adding a collar extending from the top (warm end) of the piston that can have the same outside diameter as the piston and a lip at the top of the collar that engages an "O" ring before the piston hits the bottom (cold end) of the cylinder. The top end of the collar also engages an "O" ring before the piston hits the top (warm end) of the cylinder. Since the energy that an "O" ring can absorb is proportional to its volume, having "O" rings that are near the maximum diameter of the cylinder maximize the amount of energy they can absorb. "O" rings that are used for the purpose of absorbing energy are referred to herein as bumpers or impact absorbers and are not necessarily round. While the elastomer Buna N is a preferred material other materials can also be used.

While top and bottom are used to refer to the warm and cold ends respectively, and up refers to moving from the cold end to the warm end, and down refers to moving from the warm end to the cold end, the expanders can all be operated in any orientation. Having the collar be the same diameter as the piston means that the clearances and machining tolerances that make them different are small.

SUMMARY OF THE INVENTION

The present invention provides a means of maximizing the energy absorbing capacity of bumpers that prevent the displacer or piston in a pneumatically driven cryogenic expander from hitting the cold or warm end of a cylinder. A collar is added to the warm end of the piston which can have the same outside diameter as the piston and a lip at the top end that engages an "O" ring before the piston hits the cold end or bottom of the cylinder. The top end of the collar also engages an "O" ring before the piston hits the warm end or top of the cylinder. Having "O" rings that are near the maximum diameter of the cylinder maximizes the amount of energy they can absorb, and thus permits quiet operation of larger size expanders than prior designs. The collar can also be used to drive the piston up and down in place of the typical drive stem. This design is referred to as a "collar bumper"

Figures 1, 2, 3:
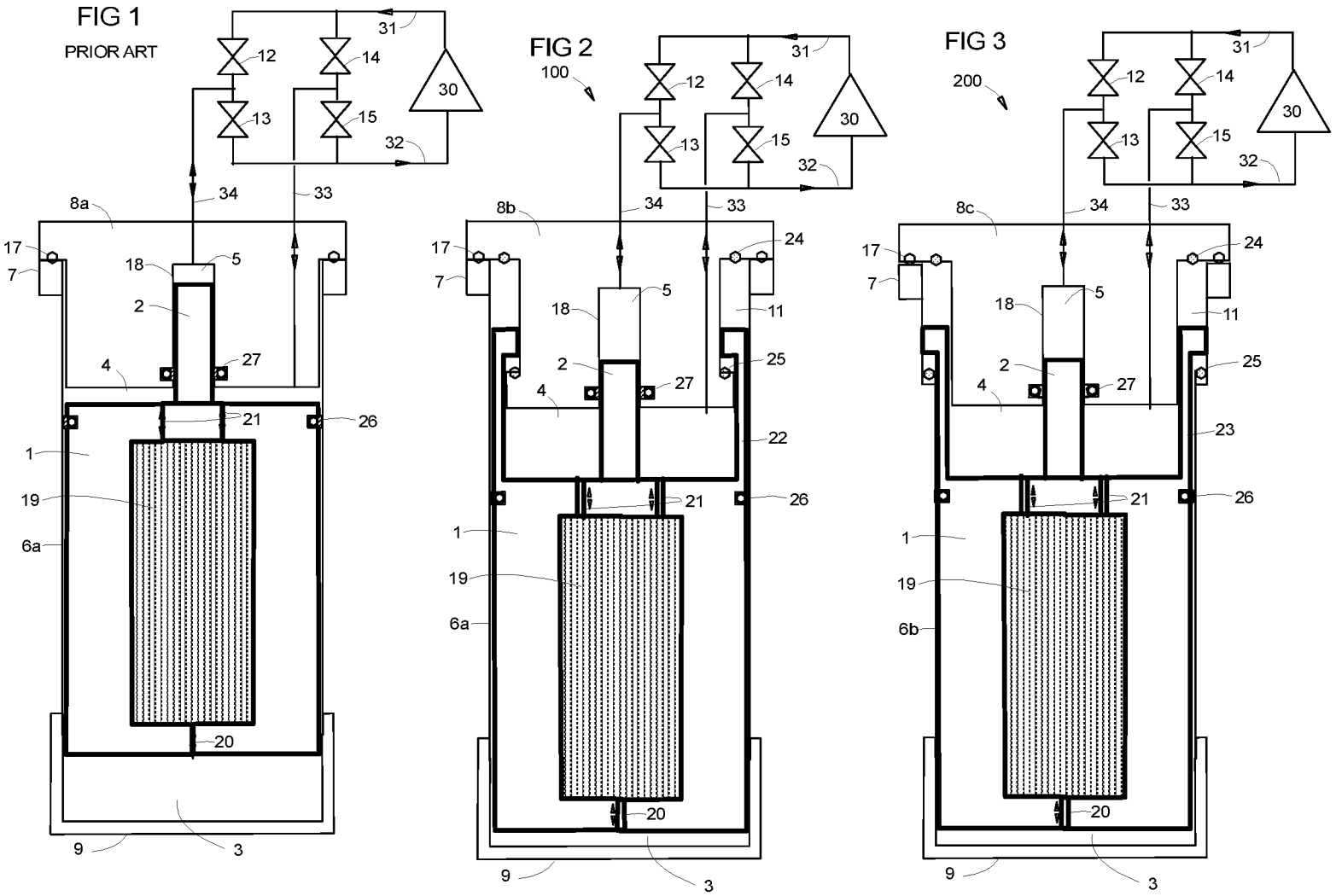
FIG 1 PRIOR ART
FIG. 1 shows a schematic of a prior art pneumatically driven GM cycle expander equivalent to the one described in U.S. Pat. No. 3,119,237.
FIG. 2 shows a schematic of a collar that has been added at the warm end of the displacer of FIG. 1 having a lip at the warm end that engages bumpers at the ends of the stroke. The collar has the same outside diameter as the piston and the bottom bumper is located internal to the collar.
FIG. 3 shows a schematic of a collar that has been added at the warm end of the displacer of FIG. 1 having a lip at the warm end that engages bumpers at the ends of the stroke. The collar has the same outside diameter as the piston and the bottom bumper is located external to the collar.

The options of having the bottom bumper be external to the collar for the Brayton expanders are not shown. Components that are equivalent in the drawings have the same identifying number.

DESCRIPTION OF THE PREFERRED EMBODIMENTS

FIG. 1 shows a schematic of a prior art pneumatically driven GM cycle expander that differs from the one shown in U.S. Pat. No. 3,119,237 only in having the regenerator internal to the piston rather than external to the cylinder All of the systems illustrated in FIGS. 1 through 7 show the same compressor 30, supply line 31 at high pressure, and return line 32 at low pressure. These gas lines can be several meters long thus providing flexibility in mounting the expander. Compressors in use today are typically oil lubricated scroll type compressors that are manufactured for air conditioning applications and are adapted to compress helium, the working fluid in most cryogenic refrigerators. Operating pressures are typically about 2.2/0.8 MPa and input power is in the range of about 2 to 12 kW. The present invention will allow pneumatically actuated expanders with higher cooling capacities to run quietly. These will require larger compressors which may be screw type compressors.

The expander has four main subassemblies. The cylinder subassembly comprises cylinder 6*a*, cold end cap 9, and warm flange 7. The piston subassembly that reciprocates in the cylinder assembly comprises piston body 1, regenerator 19, drive stem 2, and piston seal 26 near the warm end of piston body 1. The cylinder head subassembly comprises cylinder head 8*a*, stem cylinder 18, and stem seal 27. The valve subassembly, which is usually in a housing attached to the cylinder head subassembly, comprises valves 12, 13, 14, and 15. These valves are typically contained in a ported rotary valve driven by a motor. When piston 1 reciprocates it displaces gas in cold displaced volume 3, warm displaced volume 4, and drive stem displaced volume 5. While most of these volumes are displaced as piston 1 reciprocates they also include void volumes in the form of clearances and gas ports. Valves 14 and 15 cycle gas to warm displaced volume 4 through line 33 then through ports 21, regenerator 19, and port 20 to cold displaced volume 3. Valves 12 and 13 cycle gas to drive stem displaced volume 5 through line 34. Seal 17 seals cylinder head 8*a* to warm flange 7.

A GM refrigeration cycle starts with the piston at the cold end, (cold displaced volume 3 minimized), the pressure in the cylinder and on the drive stem is high (valves 12 and 14 open, valves 13 and 15 closed). Valve 12 is then closed and 13 opened. Low pressure on the drive stem causes piston 1 to move up and draw high pressure gas into cold displaced volume 3. Before the piston reaches the top valve 14 is closed and the pressure in the cylinder drops to a first pressure intermediate to the high and low pressures as the piston moves to the top. This pressure decrease results from warm gas being transferred from the warm displaced volume to the cold displaced volume. Valve 15 is then opened and the pressure in the cylinder drops to low pressure. Valve 13 is closed and 12 opened putting high pressure gas on the drive stem and pushing the piston down. Before reaching the bottom valve 15 is closed and the pressure in the cylinder increases to a second intermediate pressure as the piston moves to the bottom. This pressure increase results from cold gas being transferred from the cold displaced volume to the warm displaced volume. Valve 14 is then opened and the pressure increases to high pressure and the beginning of the next cycle. The P-V work done in cold displaced volume 3 is equal to the refrigeration produced per cycle.

FIG. 2 shows GM expander 100 which differs from the prior art design of FIG. 1, by the addition of collar 22 to piston 1, and bumper "O" rings 24 and 25. Collar 22 has an outside diameter that is about the same as piston 1 and does not rub the inside diameter of cylinder 6*a* in the length that reciprocates in the cylinder. Cylinder head 8*b* has a neck that extends inside collar 22 and supports "O" ring bumper 25 in a lip at the bottom end that is near the inner diameter of collar 22. Collar 22 has an internal lip at the top that engages "O" ring 25 when piston 1 reaches the cold end but before it hits cold end 9. When piston 1 reaches the warm end the top of collar 22 engages "O" ring 24 before it hits cylinder head 8*b*. The piston stroke is thus the distance piston 1 travels between compressed "O" rings 24 and 25, and the length of the collar has to be longer than the stroke by the length of the lips on collar 22 and cylinder head 8*b*. The space that is swept by drive collar 22, 11, is void volume that is connected to and adds to the void volume of displaced volume 4. Pressurizing and depressurizing volume 11 may use 2 to 5% of the compressor flow. The refrigeration cycle of GM expander 100 is the same as that of the GM expander of FIG. 1.

FIG. 3 shows GM expander 200 which differs from GM expander 100 by having collar 23 have a lip on the top end of the collar that is external to the outside diameter of piston 1. Cold bumper 25 is trapped in a section of the inside diameter of cylinder 6*b* above the area where piston seal 26 slides. The external lip at the top of collar 23 engages "O" ring 25 when piston 1 reaches the cold end but before it hits cold end 9. When piston 1 reaches the warm end the top of collar 23 engages "O" ring 24 before it hits cylinder head 8*c*.

Figure 4:
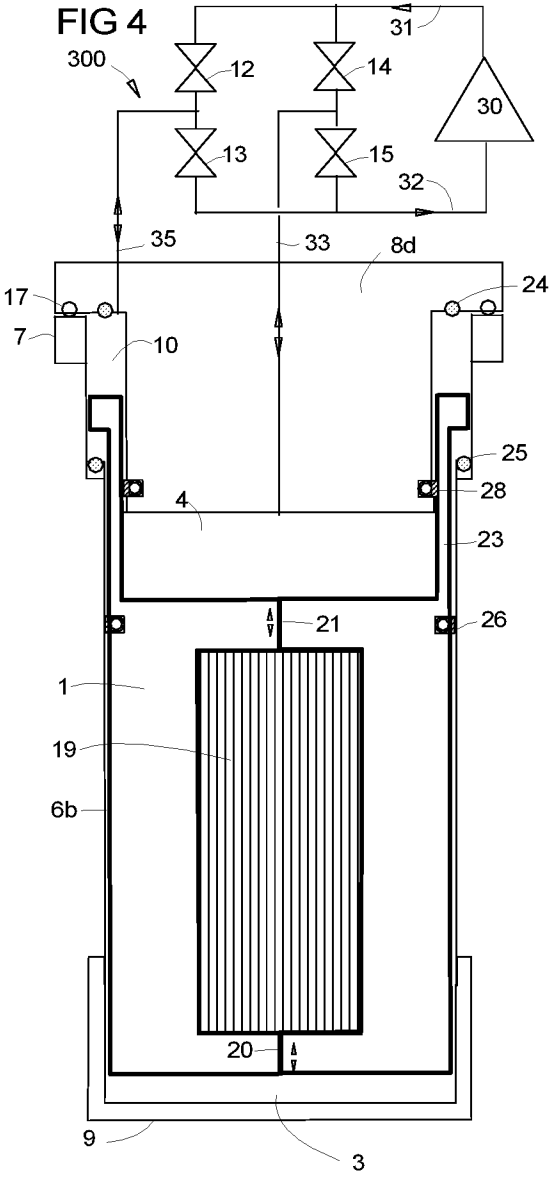
FIG. 4 shows a schematic of a collar that has been added at the warm end of a pneumatically driven GM cycle displacer having a lip at the top that engages bumpers at the ends of the stroke. The cylinder head has a neck that extends inside the collar with a seal on the inside of the collar, and the gas line that drives the displacer up and down acts on the collar. The collar has the same outside diameter as the piston and the bottom bumper is located external to the collar.

FIG. 4 shows GM expander 300 which differs from GM expander 200 by replacing drive stem 2, as the means to cause the piston to reciprocate, with collar 23. This alternate means of driving the piston simplifies the design by eliminating the need for drive stem 2, and drive stem cylinder 18, and replaces stem seal 27 with inside collar seal 28 in cylinder head 8*d*. The annular area between piston seal 26 and inner collar seal 28 is about the same as the area within stem seal 27. An area that is about 15% of the cross section area of the piston is usually sufficient to overcome friction, pressure drop, and inertial forces needed to drive the piston. The line between valves 12 and 13 and volume 10 is designated as line 35. GM expander 300 is more efficient than GM expanders 100 and 200 because volume 10 of GM expander 300 now includes the gas flow to drive the piston up and down that had been going to stem volume 5 and the void volume associated with the collar bumper is reduced. This is a preferred embodiment of this invention because cylinder head 8*d* is simpler and the assembly is simpler than other embodiments. This drive mechanism is referred to as a "collar drive" which is analogous to the conventional "stem drive".

Figure 5:
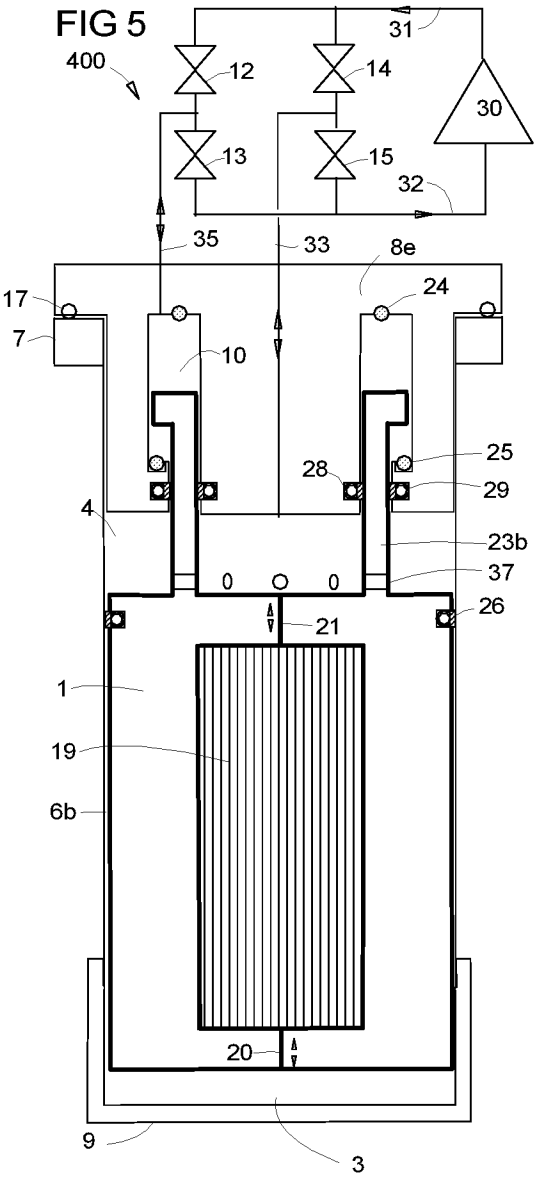
FIG. 5 is similar to FIG. 4 except the outside diameter of the collar is less than diameter of the piston and the cylinder head has a smaller inner neck and an outer section. The inner neck has a seal on the inside of the collar and the outer section has a seal on the outside of the collar. The collar has an external lip on the top that engages the bottom bumper which is in the outer section of the cylinder head.

FIG. 5 shows GM expander 400 which differs from GM expander 300 by replacing drive collar 23, which has the same outside diameter as the piston, with collar 23*b* which has a smaller outside diameter. Cylinder head 8*e* has a smaller diameter neck and inside collar seal, 28. Cylinder head 8*e* also has an outer section that holds bottom bumper 25 and also outer collar seal 29. The cross section area of collar 23*b* (between seals 28 and 29) is also about 15% (<20%) of the cross section area of the piston. Gas ports 37 in the base of collar 23*b* are needed to connect the inner and outer volumes of warm displaced volume 4. GM expander 400 has the same advantages of efficiency as GM expander 300 relative to GM expanders 100 and 200. Bumper "O" rings 24 and 25 are smaller than those that are about the same diameter as the piston but can be used with lighter pistons that do not need the maximum energy absorption of the larger bumper "O" rings. This is not a preferred embodiment of the collar bumper because it requires an additional seal, 29.

Figure 7:
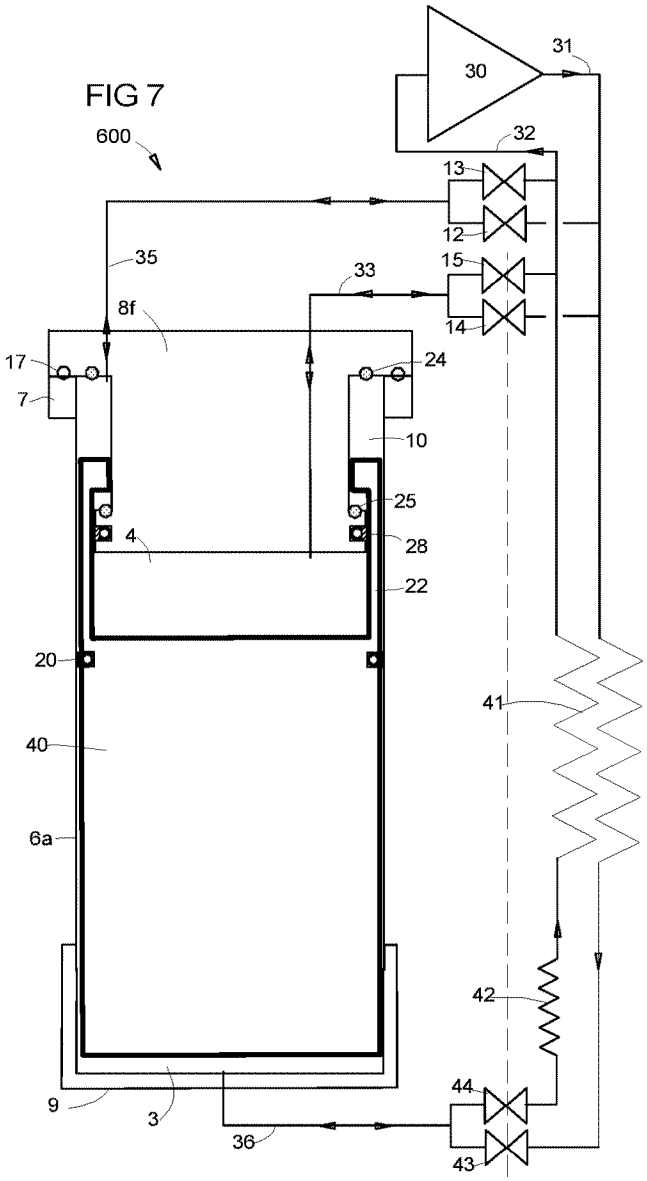
FIG. 7 is similar to FIG. 4 except the lip on the collar and the bottom bumper is internal to the collar and it applies to a pneumatically driven Brayton cycle expander.
Figure 6:
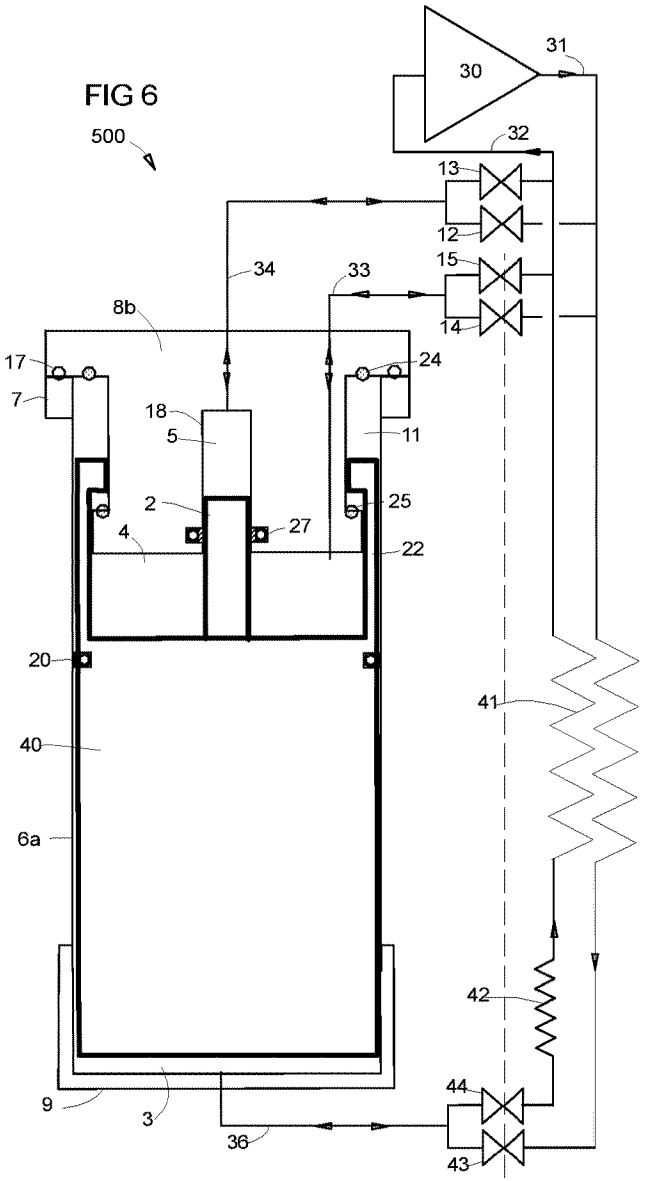
FIG. 6 is similar to FIG. 2 except it applies to a pneumatically driven Brayton cycle expander.

FIG. 6 shows Brayton expander 500 which has a stem drive and collar 22 with an internal lip, the same as GM expander 100 but the regenerator in the piston is replaced with external heat exchanger 41 and gas flow to cold displaced volume 3 is controlled by cold inlet valve 43 at high pressure and cold outlet valve 44 at low pressure, through line 36. Brayton piston 40 separates cold displaced volume 3 from warm displaced volume 4. A Brayton cycle expander has a big advantage over a GM expander in many applications because it makes the refrigeration available in remote heat exchanger 42 rather than only end cap 9. It is easier to scale to larger sizes but it also has the disadvantage of being larger and more mechanically complex. The timing of opening and closing the valves to effect the same cycle as described for the GM cycle is shown in FIG. 7 of U.S. Pat. No. 9,080,794 in connection with FIG. 1 option B.

FIG. 7 shows Brayton expander 600 which has a collar drive. Collar 22 has an internal lip at the top that engages bottom bumper 25 before piston 40 hits cold end 9. Cylinder head 8*f* has a neck that holds bottom bumper 25 and inner collar seal 28. The operation of Brayton expander 400 is the same as Brayton expander 300.

The object of this invention is to allow a cryogenic expander with a pneumatically driven piston to operate quietly in higher capacity refrigerators. The size of an "O" ring bumper is maximized by having it be about the same diameter as a piston and having a collar on the warm end of a piston with a lip at the top of the collar that engages the "O" ring bumper before it hits the cold end, and a similar "O" ring bumper that prevents it from hitting the warm end. Prior art "O" ring bumpers which have had smaller diameters have been adequate for pistons producing small amounts of refrigeration.

The rate at which refrigeration is produced is proportional to the high to low pressure difference and the rate of displacement, dV/dt, in the expansion space of a reciprocating expander. Given the same pressures the refrigeration rate is thus proportional to the square of the diameter of the piston, D, the stroke, S, and the cycle rate, N, eg. $dV/dt=(S\pi D^2N)/4$. The kinetic energy of a piston is proportional to its mass, M, and velocity squared, $(SN)^2$. If the displacement rate (refrigeration rate) is doubled by doubling the stroke or speed then the energy that has to be absorbed by the "O" ring bumpers is increased by a factor of four but the capacity of the bumper to absorb the additional energy has not changed. If the displacement rate is increased by doubling the area of the piston, and its length, stroke, and speed are kept the same then the kinetic energy is doubled, but an "O" ring bumper that is the diameter of the piston only increases in length by $D\sqrt{2}$. That is, if the displacement rate is increased by doubling the area of the piston, and its length, stroke, and speed are kept the same, then the kinetic energy is doubled and therein an "O" ring bumper that is the diameter of the piston only increases in length by D times 2.super.0.5. Regardless of what strategy is used to make larger displacement pistons lighter, a bumper "O" ring that is about the same diameter as the piston will maximize the refrigeration rate that can be produced by a pneumatically driven piston that runs quietly. A piston with a collar bumper enables this to be accomplished.

What is claimed is:

1. A cryogenic expander with reduced noise and vibration characteristics, the cryogenic expander comprising:

a cylinder;

a pneumatically driven reciprocating piston in the cylinder, the piston having a warm piston end and a cold piston end, the piston reciprocating between a warm cylinder end and a cold cylinder end, a distance of travel of the piston in the cylinder between the warm cylinder end and the cold cylinder end being defined as a stroke;

a seal at the warm piston end between the piston and said cylinder;

a bumper in the cylinder;

a collar comprising a lip outside and on a top of the collar, the collar being an extension integrated to the warm piston end, the collar having a length, between the warm piston end and the lip, that is at least as long as the stroke, the collar having an outside diameter that is the same as a diameter of the piston;

wherein the lip engages the bumper to prevent the piston from touching the cold cylinder end to reduce noise and vibration characteristics.

2. The cryogenic expander in accordance with claim 1, wherein the lip engages another bumper that prevents the piston from touching the warm end of the cylinder.

3. The cryogenic expander in accordance with claim 1, wherein the cryogenic expander operates on a GM cycle or a Brayton cycle.

4. The cryogenic expander in accordance with claim 1, further comprising a drive stem disposed on an axis of the piston at the warm piston end.

5. A cryogenic expander having a pneumatically driven reciprocating piston in a cylinder comprising:

a cylinder;

a pneumatically driven reciprocating piston in the cylinder, the piston having a warm piston end and a cold piston end, the piston reciprocating between a warm cylinder end and a cold cylinder end, a distance of travel of the piston in the cylinder between the warm cylinder end and the cold cylinder end being defined as a stroke;

a piston seal at the warm piston end between the piston and said cylinder;

a collar comprising a lip inside and on a top of the collar, the collar being an extension integrated to the warm piston end, the collar having a length, between the warm piston end and the lip, that is at least as long as the stroke, the collar having an inside diameter that is at least 90% of an outside diameter;

wherein the warm cylinder end comprises a cylinder head with a neck fixed to the cylinder head, the neck extends inside the collar, and the neck has a bumper between the neck and an inside of the collar, wherein the lip engages the bumper that prevents the piston from touching the cold cylinder end to reduce noise and vibration characteristics.

6. The cryogenic expander in accordance with claim 5, wherein the lip also engages another bumper that prevents the piston from touching the warm end of the cylinder.

7. The cryogenic expander in accordance with claim 5, wherein the cryogenic expander operates on a GM cycle or a Brayton cycle.

8. The cryogenic expander in accordance with claim 5, wherein a pneumatic force that causes the piston to reciprocate acts on the collar.

9. A cryogenic expander with reduced noise and vibration characteristics, the cryogenic expander comprising:

a cylinder;

a pneumatically driven reciprocating piston in the cylinder, the piston having a warm piston end and a cold piston end, the piston reciprocating between a warm cylinder end and a cold cylinder end, a distance of travel of the piston in the cylinder between the warm cylinder end and the cold cylinder end being defined as a stroke;

a seal at the warm piston end between the piston and said cylinder;

a collar comprising a lip on a top of the collar, the collar being an extension integrated to the warm piston end, the collar having a length, between the warm piston end and the lip, that is at least as long as the stroke, the collar having an outside diameter that is less than a diameter of the piston, the collar having a cross sectional area that is less than 20% of a cross section area of the piston;

wherein the warm cylinder end comprises a cylinder head with a neck fixed to the cylinder head, the neck extends inside the collar, and the neck has a bumper between the neck and the collar, wherein the lip engages the bumper that prevents the piston from touching the cold cylinder end to reduce noise and vibration characteristics.

10. The cryogenic expander in accordance with claim 9, wherein the lip is either inside or outside the collar.

11. The cryogenic expander in accordance with claim 9, wherein the lip also engages another bumper that prevents the piston from touching the warm cylinder end.

12. The cryogenic expander in accordance with claim 9, wherein the cryogenic expander operates on a GM cycle or a Brayton cycle.

13. The cryogenic expander in accordance with claim 9, wherein a pneumatic force that causes the piston to reciprocate acts on the collar.

14. The cryogenic expander in accordance with claim 1, wherein a pneumatic force that causes the piston to reciprocate acts on the collar.

* * * * *